US006483003B1

(12) United States Patent
De Villiers et al.

(10) Patent No.: US 6,483,003 B1
(45) Date of Patent: Nov. 19, 2002

(54) REMOVAL OF IMPURITIES FROM A HYDROCARBON COMPONENT OR FRACTION

(75) Inventors: Waldo Eugene De Villiers, Houston, TX (US); Petra De Wet, Vanderbijlpark (ZA); Magdalena Catharina Hough-Langanke, deceased, late of Parys (ZA); by Daniel Stefanus Pelser, executor, Bloemfonlein (ZA); Hubert Naude, Pretoria (ZA); Atool Govan Pema, Lenasia (ZA)

(73) Assignee: Sasol Technology (Proprietary) Limited, Johannesburg (ZA)

( * ) Notice: Subject to any disclaimer, the term of this patent is extended or adjusted under 35 U.S.C. 154(b) by 0 days.

(21) Appl. No.: 09/704,462

(22) Filed: Nov. 2, 2000

Related U.S. Application Data

(63) Continuation of application No. PCT/IB99/00827, filed on May 7, 1999.

(30) Foreign Application Priority Data

May 8, 1998 (ZA) ..... 98/3915

(51) Int. Cl.[7] ..... C07C 7/10; C07C 7/00; C10G 21/20

(52) U.S. Cl. ..... 585/862; 585/860; 585/864; 585/802; 585/833; 585/834; 208/263; 208/236; 208/237; 208/289; 208/290; 208/311; 208/330; 208/339

(58) Field of Search ..... 208/263, 236, 208/237, 289, 290, 311, 330, 339; 585/802, 833, 834, 860, 862, 864

(56) References Cited

U.S. PATENT DOCUMENTS

| | | | | | |
|---|---|---|---|---|---|
| 3,177,196 | A | * | 4/1965 | Scheibel | 208/314 |
| 3,806,445 | A | * | 4/1974 | Henry et al. | 208/18 |
| 3,864,244 | A | * | 2/1975 | Van Tassell | 208/321 |
| 3,868,310 | A | * | 2/1975 | Van Kleef et al. | 203/58 |
| 4,334,983 | A | * | 6/1982 | Mentzer | 208/311 |
| 4,342,646 | A | * | 8/1982 | Sherman | 208/326 |
| 4,401,559 | A | | 8/1983 | Gaillard | 208/262 |
| 4,761,222 | A | * | 8/1988 | Carter et al. | 208/321 |
| 5,569,788 | A | * | 10/1996 | Forte et al. | 568/697 |
| 5,675,043 | A | * | 10/1997 | Eppig et al. | 568/697 |
| 5,689,033 | A | * | 11/1997 | Forte et al. | 208/208 R |
| 5,925,234 | A | | 7/1999 | Morel et al. | 208/96 |
| 6,165,348 | A | * | 12/2000 | Morel et al. | 208/143 |
| 6,320,090 | B1 | * | 11/2001 | Sherman et al. | 208/180 |

FOREIGN PATENT DOCUMENTS

| | | |
|---|---|---|
| EP | 0661371 | 7/1995 |
| EP | 0711819 | 10/1995 |
| GB | 913731 | 12/1962 |

OTHER PUBLICATIONS

Derwent Abstract: JP59066001 dated Apr. 14, 1984, Abstract No. XP–002108238.

Derwent Abstract: JP53111001 dated Sep. 28, 1978, Abstract No. XP–002108239.

* cited by examiner

*Primary Examiner*—Walter D. Griffin
(74) *Attorney, Agent, or Firm*—Ladas & Parry

(57) ABSTRACT

A process for removing impurities from a hydrocarbon component or fraction comprises mixing, in a liquid-liquid extraction step, an impurity-containing liquid hydrocarbon component or fraction, as an impure liquid hydrocarbon feedstock, with an acetonitrile-based solvent. Thereby, at least one impurity is extracted from the hydrocarbon component or fraction into the solvent. There is withdrawn from the extraction step, as a raffinate, purified hydrocarbon component or fraction, while there is withdrawn from the extraction step, as an extract, impurity-containing solvent.

23 Claims, 4 Drawing Sheets

REMOVAL OF IMPURITIES FROM A HYDROCARBON COMPONENT OR FRACTION

This application is a continuation International Application PCT/IB99/00827 filed on May 7, 1999 and which designated the U.S., claims the benefit thereof and incorporates the same by reference.

THIS INVENTION relates to the removal of impurities from a hydrocarbon component or fraction. In particular, it relates to a process for removing impurities from a liquid hydrocarbon component or fraction.

According to the invention, there is provided a process for removing impurities from the hydrocarbon component or fraction, which process comprises mixing, in a liquid-liquid extraction step, an impurity-containing liquid hydrocarbon component or fraction, as an impure liquid hydrocarbon feedstock, with an acetonitrile-based solvent, thereby to extract at least one impurity from the hydrocarbon component or fraction into the solvent;

withdrawing from the extraction step, as a raffinate, purified hydrocarbon component or fraction; and withdrawing from the extraction step, as an extract, impurity-containing solvent.

When a hydrocarbon component or fraction, ie a hydrocarbon feedstock, is worked up to obtain particular products therefrom, impurities present in the hydrocarbon feedstock can adversely affect the quality and purity of the products obtained, can cause catalyst poisoning and increase catalyst consumption when the working up involves catalytic treatment of the hydrocarbon feedstock, and can cause unwanted side reactions to form during such work-up. The process of the present invention thus provides a means of purifying such an impure liquid hydrocarbon feedstock, prior to subjecting it to the further work-up, so that the problems associated with such work-up of the hydrocarbon feedstock, are at least reduced.

The hydrocarbon feedstock may be an olefinic and/or naphthenic hydrocarbon feedstock, which may contain at least 20% (by mass) olefins and/or naphthenes. The olefins and/or naphthenes may typically contain from 8 to 14 carbon atoms, ie the feedstock may be a $C_8$ to $C_{14}$ olefinic and/or naphthenic feedstock. Instead, for example, the feedstock may comprise a narrower cut of olefins and/or naphthenes, eg it may be a $C_8$ to $C_{10}$, a $C_{10}$, a $C_{11/12}$ or a $C_{13/14}$ olefinic and/or naphthenic feedstock.

The hydrocarbon feedstock may, in particular, be Fischer-Tropsch derived. By 'Fischer-Tropsch derived' is meant a mixture, component or fraction obtained by subjecting a synthesis gas comprising carbon monoxide and hydrogen to Fischer-Tropsch reaction conditions in the presence of an iron-based Fischer-Tropsch catalyst, a cobalt based Fischer-Tropsch catalyst, an iron/cobalt based Fischer-Tropsch catalyst, or a mixture of two or more of such Fischer-Tropsch catalysts, with the resultant Fischer-Tropsch reaction products being worked up to obtain the mixture, component or fraction in question.

The impurity or impurities present in the hydrocarbon feedstock may be at least one carboxylic acid, oxygenate, phenol, aromatic compound and/or cyclic compound. At least one of these impurities will thus be removed from the feedstock in the liquid-liquid extraction step.

Typically, the hydrocarbon feedstock may comprise, on a mass basis, 40%–60% olefins, 10%–30% paraffins, 5%–30% oxygenates such as alcohols, ketones and/or esters, 0.5%–1% phenols and/or cresols, 1%–6% carboxylic acids, and 5%–30% aromatic compounds.

While the solvent can, at least in principle, be pure acetonitrile which is immiscible with the hydrocarbon component, it will usually comprise a mixture or solution of acetonitrile and water. The water content of the solvent will be determined by factors such as the required selectivity and capacity of the solvent, the ease of operation of the extraction stage, the cost of subsequent solvent recovery, and the method used to control the water balance in the solvent. Thus, the water concentration in the acetonitrile-based solvent, on a mass basis, may, for a $C_8$–$C_{10}$ olefinic and/or naphthenic feedstock, be between 10% and 20%, preferably about 15%; for a $C_{11/12}$ olefinic and/or naphthenic feedstock between 15% and 35%, preferably about 20%; and for a $C_{13/14}$ olefinic and/or naphthenic feedstock between 20% and 35%, preferably about 25%.

The solvent to hydrocarbon component or feedstock ratio is determined by the degree of impurity removal required, and by the impurity species which it is desired to remove. In other words, it has surprisingly been found that by selecting the appropriate solvent to feedstock ratio, the impurity which is removed can be selected. Thus, for example, for almost complete removal of carboxylic acid impurities, the mass ratio of solvent to hydrocarbon feedstock may be between 0.3:1 and 2:1, typically about 0.5:1. However, for removal of carboxylic acid, oxygenate and aromatic impurities, the mass ratio of solvent to hydrocarbon feedstock may be between 1:1 and 8:1, typically about 6:1. Thus, at low solvent to feedstock ratios, virtually only carboxylic acids will be removed; at intermediate solvent to feedstock ratios, oxygenates will also be removed; and at high solvent to feedstock ratios, carboxylic acids, oxygenates and aromatics will be removed.

The liquid-liquid extraction step may, in particular, comprise counter-current extraction in which a continuous stream of the hydrocarbon feedstock passes in counter-current fashion to a continuous stream of the solvent. The extraction may, in particular, be effected in a multi-stage liquid-liquid extraction column or extractor, with the feedstock entering the column near its bottom, the solvent entering the column near its top, the raffinate being withdrawn at the top of the column, and the extract being withdrawn at the bottom of the column. The extraction column may operate at about ambient pressure or higher, eg up to a maximum of about 10 bar(a), and at about ambient temperature or higher, eg at between 30° C and 150° C.

The raffinate will normally contain some solvent, in addition to the purified hydrocarbon feedstock. The process may thus include, in a raffinate stripping step, separating solvent from the purified hydrocarbon feedstock. The raffinate stripping may typically be effected in a multi-stage stripper column with solvent being withdrawn from the top of the column and being recycled to the extraction step, and purified hydrocarbon feedstock being withdrawn from the bottom thereof.

For a $C_8$–$C_{10}$, olefinic and/or naphthenic feedstock, the raffinate stripper column may operate at above atmospheric pressure, eg at about 1.5 bar(a); however, for $C_{10}$–$C_{14}$ olefin and/or naphthenic feedstock, the pressure may vary from below atmospheric pressure to above atmospheric pressure, eg the operating pressure may then be between 0.1 bar(a) and 1.5 bar(a). The actual operating pressure will be determined by the maximum allowable bottom temperature in the column, since the purified hydrocarbon feedstock will usually be heat-sensitive.

The raffinate may be preheated before entering the stripper column, eg preheated to about 60° C.

If desired, water may be added to the raffinate stripper column, preferably below the hydrocarbon feedstock entry point. The water is then preferably preheated, eg to about 80° C. The process may then include withdrawing a bottoms product from the raffinate stripper column, and, in a phase separation step, separating the bottoms product into an aqueous phase and purified hydrocarbon feedstock or raffinate, with the aqueous phase being returned to the raffinate stripping column. Make-up water can then be added to the phase separation step for water balance. The water addition option will normally be used for a $C_{11}$–$C_{14}$ olefinic and/or naphthenic feedstock, to avoid having to operate the column under vacuum, which would require the use of a chiller unit to accommodate low overhead condensing temperatures, and larger equipment.

The extract from the liquid-liquid extraction step will contain, in addition to the solvent, also the extracted impurity or impurities, and, usually, some co-extracted hydrocarbons. The process may thus include, in an extract stripping step, separating the solvent from the impurity and the hydrocarbons, ie from an impurity/hydrocarbon mixture. The extract stripping may also be effected in a multi-stage stripper column, with solvent being withdrawn from the top of the column and being recycled to the extraction step, and the impurity/hydrocarbon mixture being withdrawn from the bottom thereof. With a $C_8$ to $C_{11}$ feedstock, co-extracted hydrocarbons are usually recovered overhead with the solvent.

The extract may be preheated, eg to about 60 □ C., before entering the extract stripper column. The column is preferably operated at above atmospheric pressure, eg at a pressure up to about 1.5 atm(a) or higher. If desired, water can be added to the extract stripper column in similar fashion as hereinbefore described in respect of the raffinate stripper column. The water, when used, will normally be preheated, eg to about 80□ C. The process may then include withdrawing a bottoms product from the extract stripper column; and, in a phase separation step, separating the bottoms product into an aqueous phase and the impurity/hydrocarbon mixture. The aqueous phase may then partially be recycled to the extract stripper column, and partially purged to achieve a water balance.

The overheads or recovered solvent from both stripper columns may thus be recycled to the extraction step. A water balance is ensured in the process by either using a membrane separation process, as a first mode of the operation, or by purging excess water from the bottom of the extract stripper column, as a second mode of the operation. The optimum operation is dependant on the composition of the feed material. When the membrane separation process is used, then the overheads or recovered solvent from either one or both the stripper columns is passed through a suitable membrane to separate water therefrom.

The invention will now be described by way of example, with reference to the accompanying drawings.

Figure 1:
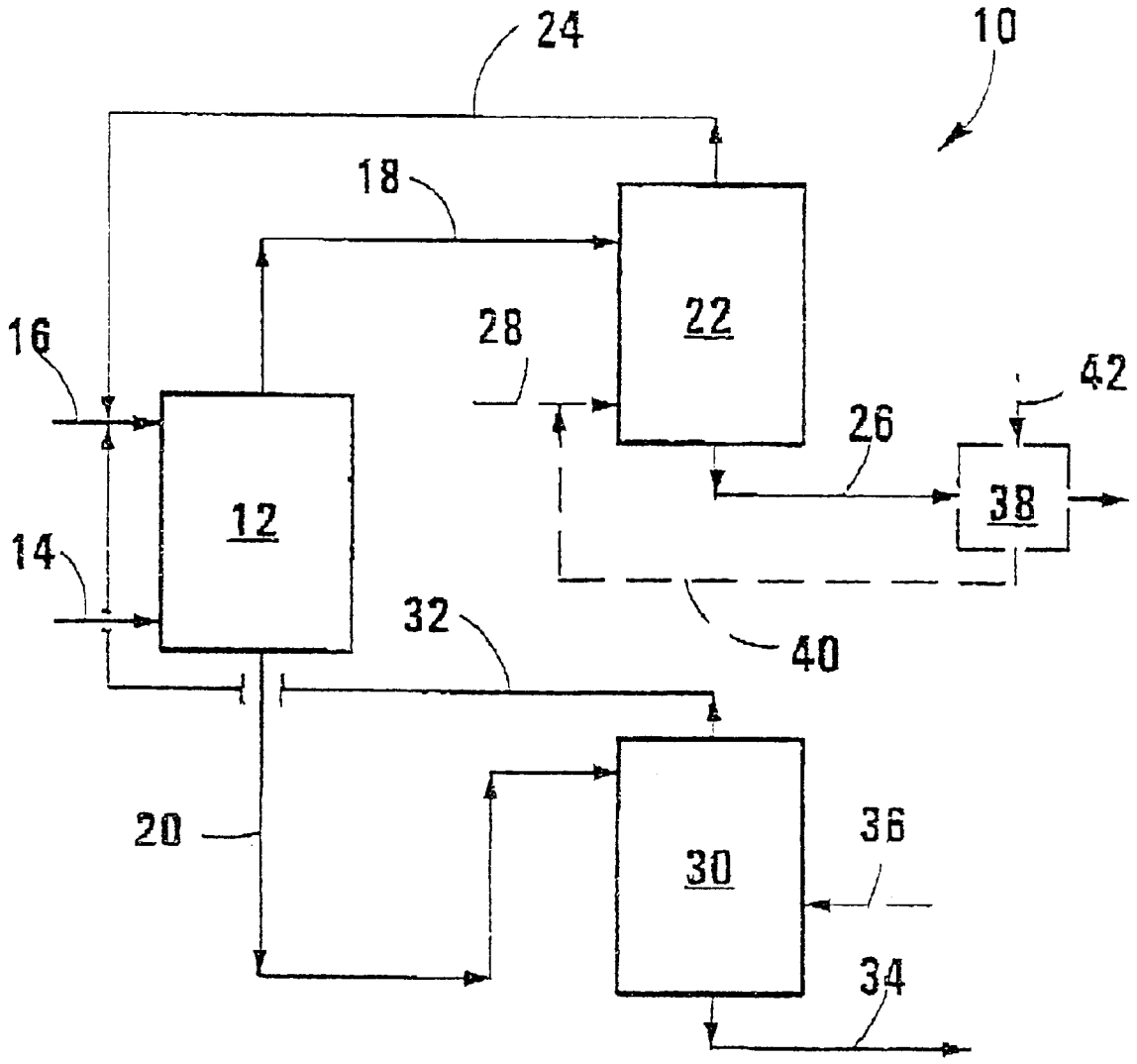
FIG. 1 shows a simplified flow diagram of one embodiment of a process according to the invention for removing impurities from a hydrocarbon component or feedstock.

Referring to FIG. 1, reference numeral 10 generally indicates a process for removing impurities from a hydrocarbon component, according to a first embodiment of the invention.

The process 10 includes an extraction column 12, which typically comprises 4 to 10 stages. A hydrocarbon feed line 14 leads into the column 12 at or near the bottom thereof, while a solvent feed line 16 leads into the column 12 near the top thereof. A raffinate withdrawal line 18 leads from the top of the extraction column 12, while an extract withdrawal line 20 leads from the bottom thereof.

The raffinate line 18 leads into a raffinate stripper column 22, hereinafter also merely referred to as 'the raffinate stripper'. A solvent withdrawal line 24 leads from the top of the stripper column 22, and leads back to the solvent line 16 to the extractor column 12. A purified hydrocarbon product withdrawal line 26 leads from the bottom of the stripper column 22. If desired, an optional water feed line 28 can lead into the stripper column 22, below the inlet of the raffinate line 18.

The extract line 20 leads into an extract stripper column 30, hereinafter also referred to as 'the extract stripper'. A solvent withdrawal line 32 leads from the top of the stripper column 30, and leads back to the solvent feed line 16 to the extractor column 12. An acidic product withdrawal line 34 leads from the bottom of the stripper column 30. If desired, a water feed line 36 can lead into the stripper column 30 below the entry point of the extract feed line 20.

In use, a $C_8$–$C_{10}$, a $C_{11/12}$ or a $C_{12/13}$ olefinic and/or naphthenic feedstock is introduced into the extraction column 12 along the line 14. Typically, the feedstock has a composition, by mass, of about 40%–60% olefins, 10%–30% paraffins, 5%–30% oxygenates, 0.5%–1% phenols and cresols, 1%–6% carboxylic acids and 5%–30% aromatics.

The hydrocarbon feedstock and solvent thus flow in continuous counter-current fashion through the extraction column or extractor 12. Depending on the solvent to feedstock mass ratio, one or more of the categories of impurities, eg the carboxylic acids or the carboxylic acids, oxygenates and aromatics will be targeted for removal from the feedstock by liquid-liquid extraction. Thus, when the solvent to feedstock mass ratio is 0.5:1, carboxylic acids will primarily be removed from the feedstock, while when the solvent to feedstock mass ratio is about 6:1, oxygenates and aromatics will also be extracted from the hydrocarbon feedstock.

The hydrocarbon feedstock and solvent thus flow in continuous counter-current fashion through the extraction column or extractor 12. Depending on the solvent to feedstock mass ratio, one or more of the categories of impurities, eg the carboxylic acids or the carboxylic acids, oxygenates and aromatics will be targeted for removal from the feedstock by liquid-liquid extraction. Thus, when the solvent to feedstock mass ratio is 0,5:1, carboxylic acids will primarily be removed from the feedstock, while when the solvent to feedstock mass ratio is about 6:1, oxygenates and aromatics will also be extracted from the hydrocarbon feedstock.

The extraction column 12 typically comprises 4–10 stages, and typically operates at a pressure of about 1.5 bar(a) and at a temperature between 40□ C. and 150□ C.

It will be appreciated that, by means of the solvent to feed mass ratio, other contaminants, apart from the carboxylic acids or aromatics, can be targeted for extraction from the hydrocarbon feedstock, such as phenols, other oxygenates or cyclic compounds. Thus, by means of the solvent to feed mass ratio, it can be ensured that a particular undesired contaminant, bearing in mind the end products to be formed from the purified hydrocarbon feedstock, can be targeted for extraction from the hydrocarbon feedstock.

A raffinate, comprising mainly purified hydrocarbon feedstock but also containing some solvent, passes along the line 18 to the stripper column 22. The stripper column 22 typically may have from 10–30 theoretical stages. In a first mode of operation thereof, the water addition line 28 will not be used. In this case, the stripper column 22 can be operated at a pressure in excess of 1.5 bar(a) when the hydrocarbon feedstock comprises $C_8$–$C_{10}$ olefins and/or naphthenes, and at a pressure between 0.15 bar(a) and 1.5 bar(a) for a $C_{10}$–$C_{14}$ olefinic and/or naphthenic feedstock. As indicated hereinbefore, the operating pressure of the stripper column is determined by the maximum allowable bottom temperature, since the final hydrocarbon product, which is withdrawn from the stripper column 22 along the line 26, may be heat-sensitive.

The raffinate enters the stripper column 22 near its upper end, and is preferably preheated to about 60° C. A reflux ratio of approximately 0.5 to 3:1 is typically used in the stripper column 22. The reflux ratio will mainly depend on the number of stages used.

In a second mode of operation, water is added along the line 28. The water addition thus takes place below the point of entry of the raffinate line 18. The water is preheated to about 80° C., and a reflux ratio of 0.5 to 3:1 is still typically used, depending on the number of stages in the stripper column 22. A bottoms product comprising both purified hydrocarbon feedstock and water is then withdrawn along the line 26, and must be subjected to phase separation, in a separation stage 38, with the aqueous phase being recycled along a flow line 40 to the flow line 28. Make-up water can be added to the phase separator 38, along a flow line 42, to ensure a proper water balance.

The water addition option can be used when the hydrocarbon feedstock comprises $C_{11}$–$C_{14}$ olefins and/or naphthenes, in order to avoid having to operate the stripper column 22 under vacuum. To operate the stripper column 22 under vacuum would require the addition of a chiller unit to accommodate low overheads condensing temperatures. Additionally, larger equipment will be required.

The extract passes from the extraction column 12 along the flow line 20 to the extract stripper column 30. The stripper column 30 typically comprises 10–30 theoretical stages, and is preferably operated at above atmospheric pressure. The feed to the stripper column 30 is preferably preheated, eg to about 60° C. The stripper column 30 can, as in the case of the stripper column 22, operate in two modes, ie with and without water addition along the line 36. If the water addition route is used, then the water will be preheated, typically to about 80° C. When the water addition option is used, then the hydrocarbon product withdrawn from the stripper column 30 along the flow line 34 will also be subjected to phase separation (not shown) similar to that employed in respect of the stripper column 22. The aqueous phase recovered from the separating stage will then be recycled to the stripper column 30 in part, with part thereof being purged to achieve a proper water balance.

Solvent recovered from the top of the stripper column 30 is recycled, along the flow line 32, to the solvent feed line 16 to the extractor column 12.

Figure 2:
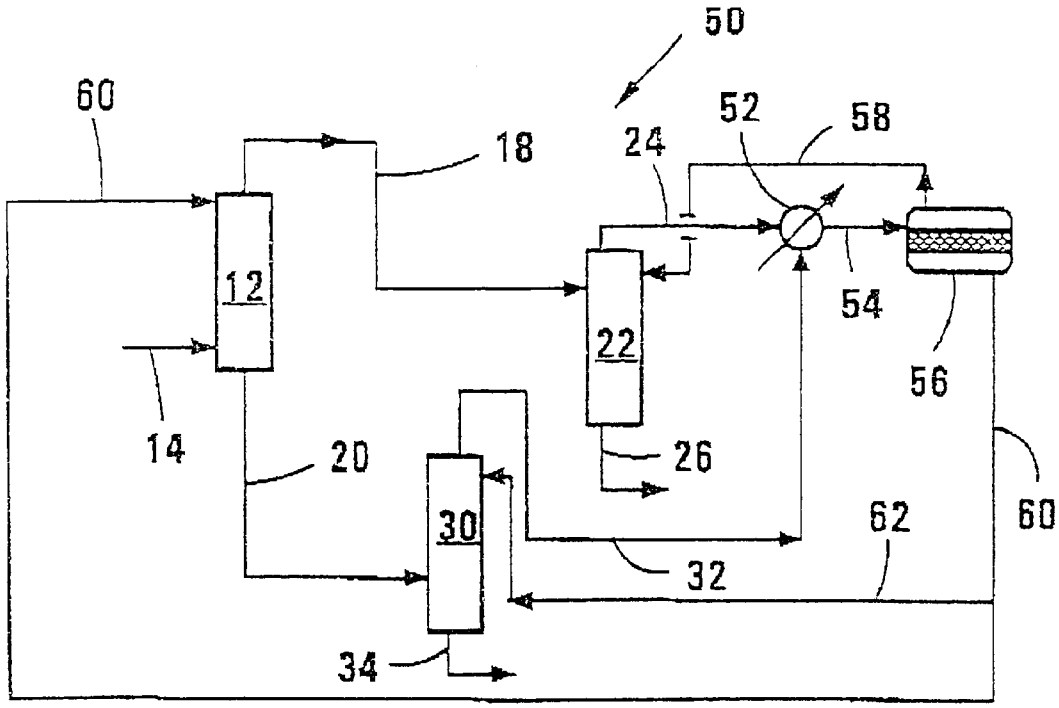
FIGS. 2 and 3 show simplified flow diagrams of other embodiments of processes according to the invention for removing impurities from a hydrocarbon component or feedstock.

Referring to FIG. 2, reference numeral 50 generally indicates a process for removing impurities from a hydrocarbon component or feedstock, according to a second embodiment of the invention.

In FIG. 2, components which are the same or similar to those shown in FIG. 1, are indicated with the same reference numerals.

The process 50 is particularly suited for processing a $C_8$–$C_{10}$ feedstock.

In the process 50, the solvent withdrawal line 24 from the top of the raffinate stripper column 22, leads to a condenser 52 where gaseous solvent and hydrocarbon recovered as an overheads stream in the stripper column 22, is condensed by heat exchange with water. A liquid product withdrawal line 54 leads from the condenser 52 to a phase separation drum 56. A return line 58 leads from the top of the drum 56 to the top of the stripper column 22. Thus, in the phase separation drum 56, condensed light (hydrocarbon rich) phase is separated out from a heavy (solvent rich) phase, with the light phase being returned to the stripper column 22 along the line 58, as reflux. The drum 56 thus also functions as a reflux drum. A heavy phase line 60 leads from the bottom of the drum 56 to the extraction column 12, for recycling recovered solvent to the extraction column 12. However, a reflux line 62 leads from the line 60 to the top of the extraction stripper column so that some heavy phase is also used as reflux in the column 30. The overheads or solvent withdrawal line 32 from the stripper column 32 also leads into the condenser 52.

Figure 3:
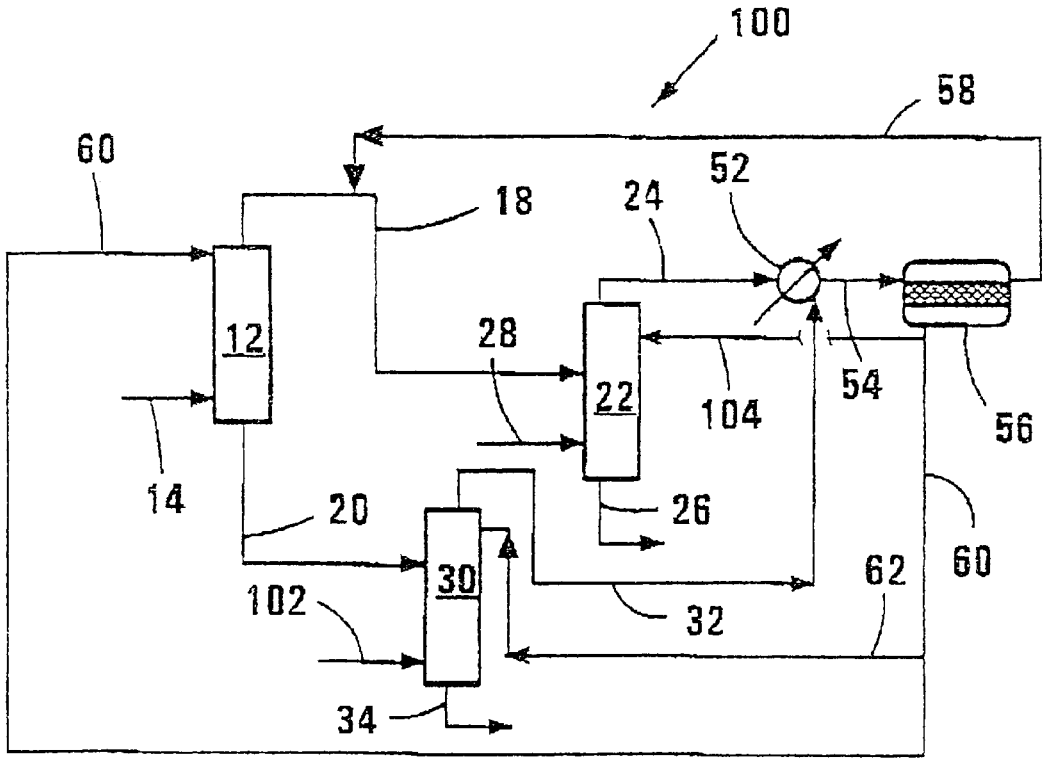

Referring to FIG. 3, reference numeral 100 generally indicates a process for removing impurities from a hydrocarbon component or feedstock, according to a third embodiment of the invention.

In FIG. 3, components which are the same or similar to those shown in FIGS. 1 and 2, are indicated with the same reference numerals.

The process 100 is particularly suited for processing a $C_{11/12}$ or a $C_{13/14}$ feedstock.

In the process 100, the light phase line 58 from the phase separator/reflux drum 56 leads into the raffinate line 18 from the extraction column 12, ie into the feed to the raffinate stripper column 22.

A water feed line 102 leads into the extract stripper column 30. The heavy phase from the drum 56 is used (i) partially as reflux to the raffinate stripper column 22, by means of a line 104 leading from the line 60; (ii) partially as reflux to the extract stripper column 30, by means of the line 62; and (iii) partially recycled to the extraction column 12, by means of the line 60.

Laboratory and other experiments were conducted, as hereinafter discussed.

EXAMPLE 1

Liquid-Liquid Equilibrium Data (Simulation of the step 12 of the process 10)

1.1 Experimental Procedure

Cross-current extractions were done at 45° C. A 20/80 mass ratio water/acetonitrile mixture was used as solvent for a $C_{11/12}$ olefinic feedstock, and a 25/75 mass ratio water/acetonitrile mixture for a $C_{13/14}$ olefinic feedstock.

The solvent and feedstock (0.1:1 mass ratio) were mixed for 30 min and allowed to phase separate for 5–10 minutes at 4° C. The mass of solvent, feed, extract and raffinate were measured for each stage, and the samples were analyzed for acids. The acid analysis was based on the ASTM method D3242-93.

1.2 Processing of Results

The acid number results reported as mg KOH/g were converted to mass % acids. The average acid molar mass assumed for the $C_{11/12}$ olefinic feedstock was 123, and for the $C_{13/14}$ feedstock 151.

Using these results, the two quantities X=(Weight of solute)/(Weight of solute-free feed solution) and Y=(weight of solute)/(Weight of solute-free extracting solvent) were calculated. The one relationship between X and Y is the distribution coefficient m, defined as Y=mX. This is the equation of the equilibrium line in a plot of Y against X. As the distribution coefficient is not constant over the extractor the equilibrium line is curved and passes through the point (0,0).

The other relationship between X and Y for systems where the feed and solvent are essentially insoluble, is $F'/S'=(Y_{Extract})/(X_{Feed}-X_{Raffinate})$ where F' is the feed rate on a solute free basis and S' is the solvent rate on a solute free basis. This is the equation of a straight line of slope F'/S' passing through the points ($X_{Feed}$, $Y_{Extract}$) and ($X_{Raffinate}$, 0), called the operating line.

With the equilibrium and operating lines plotted, the theoretical extraction stages required can be stepped off from $X_{Feed}$ down to $X_{Raffinate}$ using the standard McCabe-Thiele method commonly associated with distillation.

Figure 4:
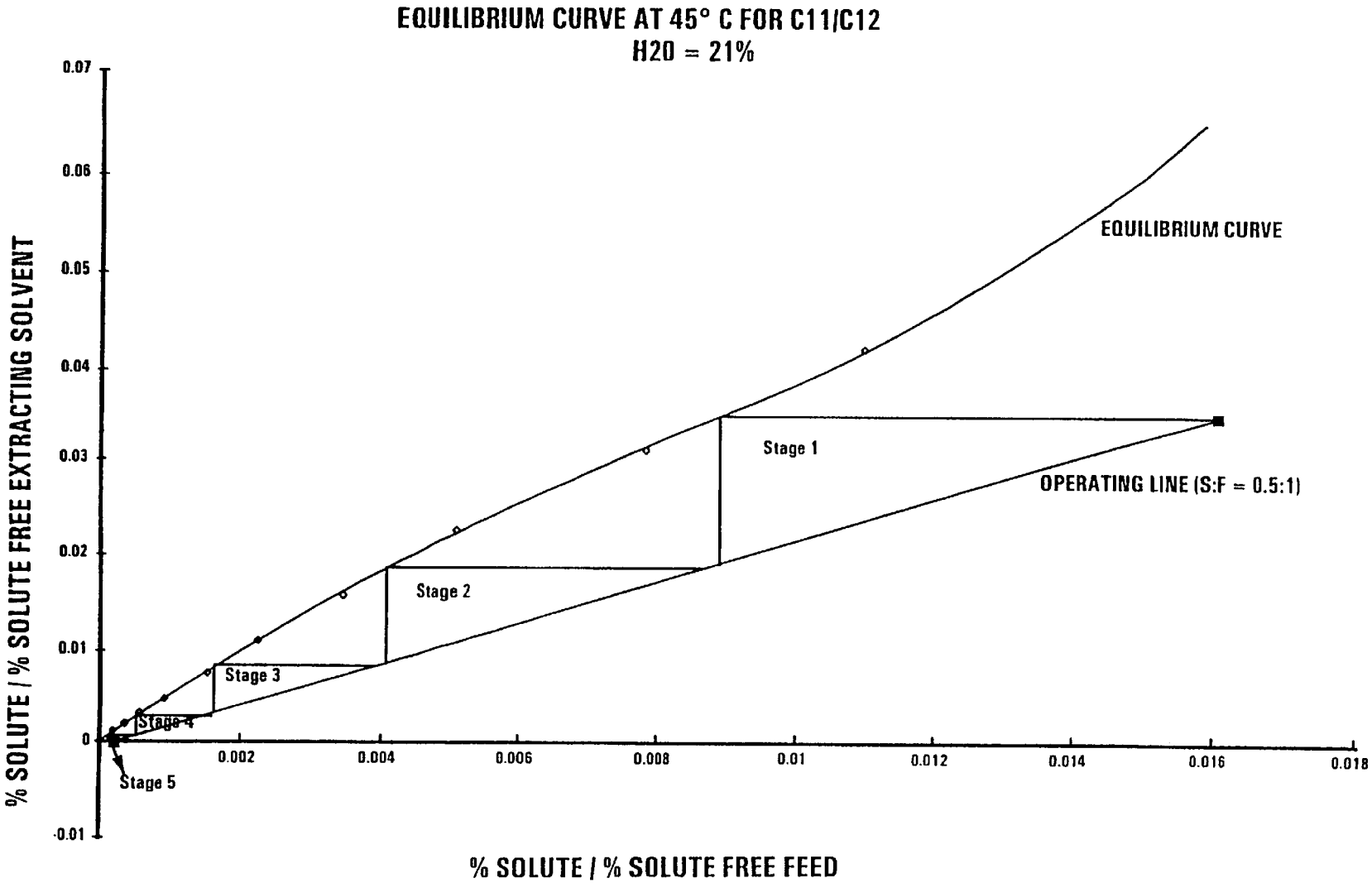
FIG. 4 shows an equilibrium curve for a $C_{11}/C_{12}$ olefinic hydrocarbon feedstock.
Figure 5:
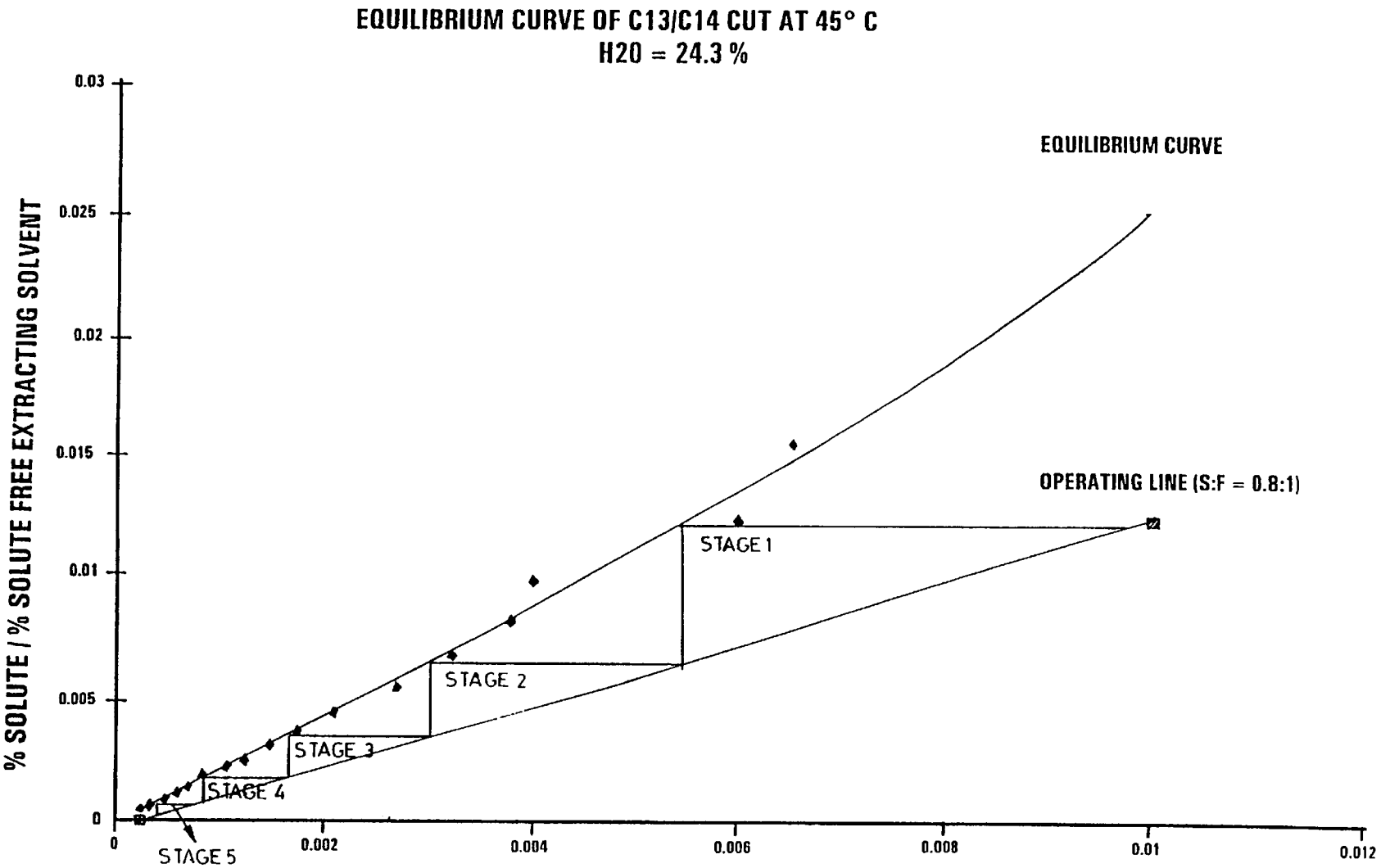
FIG. 5 shows an equilibrium curve for a $C_{13}/C_{14}$ hydrocarbon feedstock.

The results are shown in FIGS. 4 and 5 for the $C_{11/12}$ and the $C_{13/14}$ olefinic feedstocks respectively.

FIGS. 4 and 5 indicate that 5 theoretical stages will be required to reach the acid specification of 0.1 mgKOH/g at a solvent to feed ratio of 0.5:1 for the $C_{11/12}$ olefinic feedstock and 0.8:1 for the $C_{13/14}$ olefinic feedstock.

EXAMPLE 2

Proof of Concept Run 2.1 Equipment

A 47 mm glass pulsed packed extractor was used to demonstrate operation of the extraction column 12. 1.5 m of ⅛" glass Raschig (trademark) rings were used as packing for the $C_{11/12}$ olefinic feedstock. The packing was changed to 1.5 m of in-house modified stainless steel mini cascade rings for the $C_{13/14}$ olefinic feedstock to increase the fractional void area of the packed bed.

Operation of the extract stripper 30 was demonstrated on an 80 mm packed glass column fitted with 1.5 m Sulzer CY (trademark) packing.

Operation of the raffinate stripper 22 was demonstrated on a 50 mm glass Oldershaw (trademark) column modified for aqueous systems. The column had 45 actual trays.

2.2 Operating Conditions and Material Balances—$C_{11/12}$ Olefinic Feedstock Extraction Column 12

The solvent feed rate was 3.2 kg/hr, while the feedstock feed rate was 5.74 kg/hr. Thus, a solvent to feed mass ratio of approximately 0.5:1 was used. The column was operated at ambient pressure (85 kPa(a)) and temperature (27° C.). 5.4 kg/hr raffinate was produced, as was 3.54 kg/hr extract.

The raffinate stripper was operated in two modes. In a first mode, it was operated at ambient pressure, ie 87 kPa(a). The hydrocarbon feed entered at stage 20 from the top at a rate of 2.78 kg/hr and was preheated to 60° C. The stripper top temperature was 76° C. The stripper or column bottom temperature was 191° C. A reflux ratio of 2:1 was used, with 0.15 kg/hr solvent being withdrawn for recycling and 0.3 kg/hr thereof being refluxed. 2.63 kg/hr purified hydrocarbon product was withdrawn.

In a second mode of operation water was added to the column at a point 5 stages below the hydrocarbon feed point (stage 20), while operating the stripper at atmospheric pressure, ie 87 kPa(a). The water was added to the column to reduce the bottom temperature. The addition of water will enable the operation of the commercial plant at atmospheric or higher pressures at acceptable bottom temperatures (temperature sensitive bottom product). The alternative to adding water is operating under vacuum which implies adding a chiller unit to accommodate low overhead condensing temperatures and larger equipment.

The column bottom temperature was 100° C. for this mode of operation. The water feed was preheated to 65° C., with water being added at a rate of 0.3 kg/hr with a raffinate feed rate of 1.03 kg/hr. The raffinate was preheated to 60° C. The stripper top temperature was 73° C. A reflux ratio of 3:1 was used, with 0.06 kg/hr solvent being withdrawn for recycling, and the reflux being 0.18 kg/hr. The bottom product was phase separated with the aqueous phase being recycled to the column. Make-up water was added to the phase separator to ensure a proper water balance.

The aqueous phase was generated at a rate of 0.345 kg/hr, while the purified product was produced at a rate of 0.925 kg/hr.

Extract Stripper 30

Water was added to the extract stripper to achieve a lower bottom temperature. This will again ensure that a commercial plant can operate at atmospheric or higher pressures at acceptable bottom temperatures. Too high bottom temperatures can result in corrosion and unwanted temperature catalyzed hydrolysis reactions.

The column was operated at atmospheric pressure, ie 87 kPa(a). The hydrocarbon and water feed entered the column 0.5 m from the top. The hydrocarbon feedstock was preheated to 60° C. and the water to 80° C. The feedstock rate was 1.43 kg/hr, while the water addition rate was 0.26 kg/hr. A reflux ratio of 1.67:1 was used, with 1.3 kg/hr solvent being recycled, while the reflux thereof was 2.2 kg/hr. The bottom product was phase separated, with the aqueous phase (0.21 kg/hr) partially being recycled to the column and partially being purged to achieve a water balance. The acidic product rate was 0.18 kg/hr. The column bottom temperature was 98° C., while its top temperature was 72° C.

2.3 Operating Conditions and Material Balances—$C_{13/14}$ Olefinic Feedstock Extraction Column 12

A solvent to feedstock mass ratio of 1:1 was used. The column was operated at ambient pressure (85 kPa abs), and at both ambient (27° C.) (Mode 1) and at elevated temperature (43° C.) (Mode 2).

The operation of the extract and raffinate strippers was similar to that for the $C_{11/12}$ run.

Mode 1: $C_{13}/C_{14}$ feedstock rate 2.08 kg/hr; solvent rate 2.04 kg/hr; raffinate rate 2.06 kg/hr; extract rate 2.06 kg/hr Mode 2: $C_{13}/C_{14}$ feedstock rate 1.89 kg/hr; solvent rate 1.97 kg/hr; raffinate rate 1.71 kg/hr; extract rate 2.16 kg/hr 2.4 Analytical Results 2.4.1 $C_{11/12}$ Olefinic Feedstock Acid, phenol and water analyses and density measurements were done on selected streams during the tests to monitor the process. The results from these analyses are summarized in Table 1.

2.4.2 $C_{13/14}$ Olefinic Feedstock

Acid, phenol and water analyses and density measurements were done on selected streams during the tests to monitor the process. The results from these analyses are summarized in Table 2.

TABLE 1

| Stream Description | Density @ 20° C. kg/m³ | Water Mass % | Acids mgKOH/g | Acetonitrile ppm | Phenols ppm |
|---|---|---|---|---|---|
| Extractor | | | | | |
| Solvent Feed | 813 | 17.1 | <0.01 | | |
| Linear Olefin Feed | 803 | 0.03 | 7.74 | | |
| Raffinate | 791 | 0.09 | 0.01 | | 25 |
| Extract | 827 | 15.4 | 12.08 | | |
| Raffinate Stripper Mode 1 | | | | | |
| Hydrocarbon Feed | | 0.08 | 0.01 | | |
| Overhead Product | | 2.4 | <0.01 | | |
| Bottom Product | | 0.02 | 0.02 | <10 | 20 |
| Raffinate Stripper Mode 2 | | | | | |
| Hydrocarbon Feed | | 0.08 | 0.01 | | |
| Water Feed | | 99.7 | 0.02 | | |
| Overhead Product | | 19.1 | 0.01 | | |
| Bottom Product - Light phase | | 0.04 | 0.01 | <10 | 20 |
| Bottom Product - Heavy phase | | 98.4 | 0.03 | | |
| Extract Stripper | | | | | |
| Hydrocarbon Feed | | 15.2 | 12.18 | | |
| Water Feed | | 97.4 | 5.16 | | |
| Overhead Product | | 18.8 | 0.02 | | |
| Bottom Product - Light phase | | 2.4 | 79.64 | <10 | |
| Bottom Product - Heavy phase | | 97.4 | 5.86 | | |

TABLE 2

| Stream Description | Density @ 20° C. kg/m³ | Water Mass % | Acetonitrile ppm | Acids mgKOH/g | Phenols ppm |
|---|---|---|---|---|---|
| Extractor Mode 1 | | | | | |
| Solvent Feed | 836 | 25 | | 0.01 | |
| Linear Olefin Feed | 817 | 0.03 | | 3.6 | |
| Raffinate | 809 | 0.06 | | 0.09 | 25 |
| Extract | 845 | 24.8 | | 3.53 | 955 |
| Extractor Mode 2 | | | | | |
| Solvent Feed | 836 | 24.4 | | 0.01 | |
| Linear Olefin Feed | 817 | 0.03 | | 3.6 | |
| Raffinate | 809 | 0.06 | | 0.02 | |
| Extract | 844 | 24.2 | | 3.52 | |
| Extract Stripper | | | | | |
| Bottom Product - Light phase | | | <10 | | |

EXAMPLE 3

Design Data Run 3.1 Equipment 3.1.1 $C_8$–$C_{10}$ feedstock or cut

The equipment was essentially set up in accordance with FIG. 2.

Extraction

A 40 mm diameter glass packed extractor was used to generate design data for the extraction column 12. The column was fitted with 4 m Sulzer BX (trademark) packing.

Solvent Recovery

Two 78 mm diameter stainless steel packed distillation columns were used to generate design data for the extract (30) and raffinate (22) strippers. Both columns were fitted with 4 m Sulzer DX (trademark) packing. The columns thus had the combined overhead condenser 52 and reflux drum 56, as shown in FIG. 2. Phase separation took place in the ref lux drum 56 with the light (hydrocarbon rich) phase being refluxed to the raffinate stripper 22 and the heavy (solvent rich) phase being partly used as reflux for the extract stripper 30 and partly recycled to the extractor 12.

A 50 mm diameter glass pulsed packed extractor was used to generate design data for the extraction column 12. The column was fitted with 6 mm glass raschig rings to a total height of 1.5 m.

3.1.3 $C_{11/12}$ and $C_{13/14}$ Feedstocks or Cuts

The equipment was essentially set up in accordance with FIG. 3.

Extraction

A 168 mm-diameter stainless steel packed extractor was used to generate design data for the extraction column 12. The column was fitted with 4.7 m Sulzer SMV (trademark) packing.

Solvent Recovery

Two 78 mm diameter stainless steel packed distillation columns were used to generate design data for the extract (30) and raffinate (22) strippers. Both columns were fitted with 3 m Sulzer DX (trademark) packing. The columns thus had a combined overhead condenser 52 and reflux drum 56. Phase separation took place in the reflux drum 56 with the light (hydrocarbon rich) phase being recycled to the feed of the raffinate stripper 22, and the heavy (solvent rich) phase partly being used as reflux for both strippers 22, 30 and partly recycled to the extractor 12.

3.2 Operating Conditions and Material Balances 3.2.1 $C_8$–$C_{14}$ Olefinic Feedstock Extraction Column 12

The solvent rate was 1.2 kg/h; while the feedstock feed rate was 2.2 kg/h. Thus, a solvent to feed ratio of approximately 0.55:1 was used. The column was operated at 150 kPa(a) and 45° C. 1.75 kg/h raffinate was produced, as was 1.65 kg/h extract.

Raffinate Stripper 22

The raffinate stripper was operated at 150 kPa(a). The hydrocarbon feed entered at stage from the top at a rate of 1.75 kg/h and was preheated to 55° C. The stripper top temperature was 80° C. The bottom temperature was 128° C. A reflux rate of 0.7 kg/h was used. 1.95 kg/h purified hydrocarbon product was withdrawn as bottom product.

Extract Stripper 30

The extract stripper was operated at 150 kPa(a). The feed entered at stage 20 from the top at a rate of 1.65 kg/h and was preheated to 75° C. The stripper top temperature was 86° C. The bottom temperature was 164° C. A reflux rate of 1.6 kg/h was used. The acidic product rate was 0.25 kg/h.

3.2.2 $C_{10}$ Olefinic Feedstock

Extraction Column 12

The solvent rate was varied between 2.2 and 7.3 kg/h while the feed was kept constant at 0.6 kg/h. The column was operated at 85 kPa(a) and 25° C.

3.2.3 $C_{11/12}$ Olefinic Feedstock

Extraction Column 12

The solvent rate was 175 kg/h; while the feedstock feed rate was 350 kg/h. Thus, a solvent to feed ratio of 0.5:1 was used. The column was operated at 150 kPa(a) and 45° C. 333 kg/h raffinate was produced, as was 192 kg/h extract.

Raffinate Stripper 22

The raffinate stripper was operated at 150 kPa(a). The hydrocarbon feed entered at stage from the top at a rate of 3.6 kg/h and was preheated to 66° C. The stripper top temperature was 87° C. Water was added to the reboiler (0.8 kg/h) to reduce the bottom temperature. The addition of water will enable a commercial plant to be operated at atmospheric or higher pressures at acceptable bottom temperatures, which is desired for temperature sensitive bottom products. The bottom temperature was 127° C. A reflux rate of 0.23 kg/h was used. 2,9. kg/h purified hydrocarbon product (after phase separation) was withdrawn as bottom product.

Extract Stripper 30

The extract stripper was operated at 150 kPa(a). The hydrocarbon feed entered at stage 10 from the top at a rate of 1.8 kg/h and was preheated to 50° C. The stripper top temperature was 86° C. Water was added to the reboiler (0.1 kg/h) to reduce the bottom temperature. The addition of water will enable a commercial plant to be operated at atmospheric or higher pressures at acceptable bottom temperatures, which is desired for temperature sensitive bottom products. The bottom temperature was 105° C. A reflux rate of 1.76 kg/h was used. The acidic product rate was 0.3 kg/h.

3.2.4 $C_{13/14}$ Olefinic Feedstock

Extraction Column 12

The raffinate stripper was operated at 150 kPa(a). The hydrocarbon feed entered at stage 10 from the top at a rate of 2.4 kg/h and was preheated to 66° C. The stripper top temperature was 88° C. Water was added to the reboiler (0.75 kg/h) to reduce the bottom temperature. The addition of water will enable a commercial plant to be operated at atmospheric or higher pressures at acceptable bottom temperatures, which is desired for temperature sensitive bottom products. The bottom temperature was 117° C. A reflux rate of 1 kg/h was used. 2.2 kg/h purified hydrocarbon product (after phase separation) was withdrawn as bottom product.

Raffinate Stripper 22

The raffinate stripper was operated at 150 kPa(a). The hydrocarbon feed entered at stage 10 from the top at a rate of 2,4 kg/h and was preheated to 66° C. The stripper top temperature was 88° C. Water was added to the reboiler (0,75 kg/h) to reduce the bottom temperature. The addition of water will enable a commercial plant to be operated at atmospheric or higher pressures at acceptable bottom temperatures, which is desired for temperature sensitive bottom products. The bottom temperature was 117° C. A reflux rate of 1 kg/h was used. 2,2 kg/h purified hydrocarbon product (after phase separation) was withdrawn as bottom product.

Extract Stripper 30

The extract stripper was operated at 150 kPa(a). The hydrocarbon feed entered at stage 10 from the top at a rate of 2.7 kg/h and was preheated to 50° C. The stripper top temperature was 87° C. Water was added to the reboiler (1 kg/h) to reduce the bottom temperature. The addition of water will enable a commercial plant to operate at atmospheric or higher pressures at acceptable bottom temperatures, which is desired for temperature sensitive bottom products. The bottom temperature was 106° C. A reflux rate of 1.45 kg/h was used. The acidic product rate was 0.13 kg/h.

3. Analytical Results

Acid and other analyses, and density measurements, were done on selected streams during the tests to monitor the processes. The results of these analyses are summarized in Tables 3, 4, 5, and 6.

TABLE 3

| $C_8$–$C_{10}$ olefinic feedstock | | | |
|---|---|---|---|
| Stream Description | Density @ 20° C. kg/m$^3$ | Water Mass % | Acids mgKOH/g |
| Extractor | | | |
| Solvent Feed | 791 | 9.90 | |
| Olefin Feed | 756 | 0.16 | 18.00 |
| Raffinate | 750 | 1.40 | |
| Extract | 800 | | |
| Raffinate Stripper | | | |
| Hydrocarbon Feed | 750 | 0.16 | |
| Reflux | 736 | 0.17 | |
| Bottom Product | 738 | 0.02 | 0.06 |
| Extract Stripper | | | |
| Hydrocarbon Feed | 800 | | |
| Reflux | 791 | 9.90 | |
| Bottom Product | 834 | 0.09 | 46.5 |

TABLE 4

| $C_{10}$ olefinic feedstock | | |
|---|---|---|
| Stream Description | Flow Rate kg/h | Total Mass % Oxygenates/Aromatics |
| Extractor | | |
| Solvent Feed | 2.30 | |
| Olefin Feed | 0.65 | 20.20 |
| Raffinate | 0.55 | 2.28 |
| Extract | 2.40 | |
| Extractor | | |
| Solvent Feed | 3.62 | |
| Olefin Feed | 0.65 | 20.20 |
| Raffinate | 0.49 | 0.37 |
| Extract | 3.78 | |
| Extractor | | |
| Solvent Feed | 5.40 | |
| Olefin Feed | 0.65 | 20.20 |
| Raffinate | 0.43 | 0.07 |
| Extract | 5.62 | |
| Extractor | | |
| Solvent Feed | 7.30 | |
| Olefin Feed | 0.65 | 20.20 |
| Raffinate | 0.37 | 0.03 |
| Extract | 7.58 | |

TABLE 5

| $C_{11/12}$ olefinic feedstock | | | |
|---|---|---|---|
| Stream Description | Density @ 20° C. kg/m$^3$ | Water Mass % | Acids mgKOH/g |
| Extractor | | | |
| Solvent Feed | 815 | 18.40 | |
| Olefin Feed | 801 | 0.03 | 7.26 |
| Raffinate | 789 | 0.28 | 0.02 |
| Extract | 828 | 16.78 | |
| Raffinate Stripper | | | |
| Hydrocarbon Feed | 786 | 0.28 | |
| Water | 980 | | |
| Reflux | 815 | 18.40 | |
| Bottom Product - Light Phase | 786 | 0.05 | 0.03 |

TABLE 5-continued

| $C_{11/12}$ olefinic feedstock | | | |
|---|---|---|---|
| Stream Description | Density @ 20° C. kg/m$^3$ | Water Mass % | Acids mgKOH/g |
| Extract Stripper | | | |
| Hydrocarbon Feed | 828 | 16.78 | |
| Water | 980 | | |
| Reflux | 815 | 18.40 | |
| Bottom Product - Light Phase | 896 | 2.02 | 88.0 |

TABLE 6

| $C_{13/14}$ olefinic feedstock | | | |
|---|---|---|---|
| Stream Description | Density @ 20° C. kg/m$^3$ | Water Mass % | Acids mgKOH/g |
| Extractor | | | |
| Solvent Feed | 833 | 25.62 | |
| Olefin Feed | 816 | 0.08 | 3.47 |
| Raffinate | 800 | 0.46 | 0.04 |
| Extract | 837 | 24.24 | |
| Raffinate Stripper | | | |
| Hydrocarbon Feed | 800 | 0.46 | |
| Water | 980 | | |
| Reflux | 833 | 25.62 | |
| Bottom Product - Light Phase | 795 | 0.04 | 0.09 |
| Extract Stripper | | | |
| Hydrocarbon Feed | 837 | 24.24 | |
| Water | 980 | | |
| Reflux | 833 | 25.62 | |
| Bottom Product - Light Phase | 922 | 1.32 | 59.0 |

It was surprisingly found that, in the processes 10, 50 and 100 comprising liquid-liquid extracting using the acetonitrile-based solvent, effective removal of acids, oxygenates, phenols, aromatics and cyclic compounds from an olefin and/or naphthenic feedstock, can be achieved. Additionally, it was found that by changing the solvent to feedstock mass ratio, specific impurities or groups of impurities can be removed from the feedstock material. This removal can thus be tailored to the downstream processing requirements of the feedstock. Another unique feature is that, in the range of $C_8$–$C_{11}$ olefins, where the olefins solubility in the solvent is appreciable, acetonitrile forms an azeotrope with the olefinic and paraffinic material. Any olefins co-extracted are thus recovered in the subsequent solvent recovery stages, and recycled to the extraction stage. Olefin losses in the $c_{12}$–$C_{14}$ range are negligible.

What is claimed is:

1. A process for purifying an impure liquid hydrocarbon feedstock, which process includes mixing, in a liquid-liquid extraction step, a Fischer-Tropsch derived impure liquid hydrocarbon feedstock comprising a liquid hydrocarbon component or fraction containing at least one impurity selected from a carboxylic acid, an oxygenate, a phenol, an aromatic compound and a cyclic compound, with a solvent comprising acetonitrile, thereby to extract the impurity, or at least one of the impurities, from the hydrocarbon component or fraction into the solvent;

withdrawing from the extraction step; as a raffinate, purified hydrocarbon component or fraction together with some solvent;

withdrawing from the extraction step, as an extract, impurity containing solvent;

in a raffinate stripping step, separating solvent from the raffinate in a raffinate stripper column;

adding water to the raffinate stripper column below the raffinate entry point;

withdrawing solvent from the top of the raffinate stripper column;

withdrawing a bottoms product comprising water and purified hydrocarbon component or fraction from the raffinate stripper column;

in a phase separation step, separating the bottoms product into an aqueous phase and purified hydrocarbon component or raffinate.

2. A process according to claim 1, wherein the impure liquid hydrocarbon feedstock contains at least 20% (by mass) olefins or at least 20% (by mass) naphthenes or at least 20% (by mass) olefins and naphthenes.

3. A process according to claim 2, wherein the hydrocarbon feedstock comprises, on a mass basis, 40%–60% olefins, 10%–30% paraffins, 5%–30% oxygenates, 0.5%–1% phenols and/or cresols, 1%–6% carboxylic acids, and 5%–30% aromatic compounds.

4. A process according to claim 2 wherein, for removal of carboxylic acid impurities, the mass ratio of solvent to hydrocarbon feedstock is between 0.3:1 and 2:1.

5. A process according to claim 2, wherein, for removal of carboxylic acid, oxygenate or aromatic compound impurities, the mass ratio of solvent to hydrocarbon feedstock is between 1:1 and 8:1.

6. A process according to claim 2, wherein the solvent comprises a mixture or solution of acetonitrile and water, with the water concentration in the acetonitrile-based solvent, on a mass basis, for a $C_8$–$C_{10}$ olefinic and/or naphthenic feedstock being between 10% and 20%; for a $C_{11/12}$ olefinic and/or naphthenic feedstock being between 15% and 35%; and for a $C_{13/14}$ olefinic and/or naphthenic feedstock being between 20% and 35%.

7. A process according to claim 2, wherein the liquid-liquid extraction step is effected in a liquid-liquid extraction column, with the hydrocarbon feedstock entering the column near its bottom, the solvent entering the column near its top, the raffinate being withdrawn at the top of the column, and the extract being withdrawn at the bottom of the column, the column operating at about ambient pressure or at a higher pressure up to a maximum of 10 bar(a), and at about ambient temperature or at a higher temperature between 30° C. and 150° C.

8. A process according to claim 1, wherein the solvent that is withdrawn from the top of the raffinate stripper column is recycled to the extraction step, and wherein the raffinate is preheated prior to entering the raffinate stripper is preheated prior to entering the raffinate stripper column.

9. A process according to claim 1, which includes returning the aqueous phase from the phase separation step to the raffinate stripper column.

10. A process according to claim 1, wherein the extract comprises solvent, the extracted impurity, and some co-extracted hydrocarbons, with the process including, in an extract stripping step, separating the solvent from an impurity/hydrocarbon mixture in an extract stripper column, with solvent being withdrawn from the top of the extract stripper column and being recycled to the extraction step, and the impurity/hydrocarbon mixture being withdrawn from the bottom thereof, and with the extract optionally being preheated before entering the extract stripper column.

11. A process according to claim 10, which includes adding water to the extract stripper column below the extract entry point; withdrawing a bottoms product from the extract stripper column; in a phase separation step, separating the bottoms product into an aqueous phase and the impurity/hydrocarbon mixture; and recycling part of the aqueous phase to the column, while purging the remainder thereof to achieve a water balance.

12. A process according to claim 10, which include recycling the overheads or recovered solvent from the stripper columns to the extraction step.

13. A process according to claim 1, wherein the solvent comprises an acetonitrile/water solution.

14. A process according to claim 2, wherein the solvent comprises an acetonitrile/water solution.

15. A process according to claim 3, wherein the solvent comprises an acetonitrile/water solution.

16. A process according to claim 4, wherein the solvent comprises an acetonitrile/water solution.

17. A process according to claim 5, wherein the solvent comprises an acetonitrile/water solution.

18. A process according to claim 7, wherein the solvent comprises an acetonitrile/water solution.

19. A process according to claim 8, wherein the solvent comprises all acetonitrile/water solution.

20. A process according to claim 9, wherein the solvent comprises an acetonitrile/water solution.

21. A process according to claim 10, wherein the solvent comprises an acetonitrile/water solution.

22. A process according to claim 10, wherein the solvent comprises an acetonitrile/water solution.

23. A process according to claim 12, wherein the solvent comprises an acetonitrile/water solution.

* * * * *